United States Patent [19]

Kostka et al.

[11] 4,140,259

[45] Feb. 20, 1979

[54] TICKET DISPENSER

[76] Inventors: Frank Kostka, 3844 W. 26th St., Chicago, Ill. 60623; Robert L. Moore, 919 Coronet La., LaGrange, Ill. 60625

[21] Appl. No.: 832,288

[22] Filed: Sep. 12, 1977

[51] Int. Cl.[2] ..... B26F 3/02

[52] U.S. Cl. ..... 225/16; 83/205; 83/278; 83/282; 194/10; 221/93

[58] Field of Search ..... 225/16, 10; 83/205, 83/278, 203; 226/120, 67; 194/2, 10; 221/93; 312/39, 35, 41

[56] References Cited

U.S. PATENT DOCUMENTS

| | | | |
|---|---|---|---|
| 641,333 | 1/1900 | Saltzkorn et al. | 83/278 |
| 1,650,556 | 11/1927 | Weber | 83/278 X |
| 2,171,898 | 9/1939 | Scher | 83/205 |
| 2,638,822 | 5/1953 | Mackechnie, Jr. | 83/278 X |
| 2,742,338 | 4/1956 | Abbott | 225/16 X |
| 3,018,148 | 1/1962 | Probasco | 221/93 X |
| 3,246,797 | 4/1966 | Hoenisch | 225/10 X |
| 3,317,082 | 5/1967 | Ohlsson et al. | 221/93 X |

*Primary Examiner*—Frank T. Yost

*Attorney, Agent, or Firm*—McDougall, Hersh & Scott

[57] ABSTRACT

A vending machine for vending goods or services of the type requiring the insertion of coins or tokens of a certain value in order to obtain the goods or services. A ticket dispensing apparatus is associated with the machine whereby a ticket will be dispensed by the machine in addition to the vending of the goods or services. The ticket will be redeemable by the user of the machine for something of value in addition to the goods or services received. Feeding means are employed for dispensing the tickets at a ticket delivery position, the feeding means being operable by the actuating means of the machine. These actuating means are operable only upon the insertion of coins or tokens of sufficient value and, therefore, the tickets are dispensed only upon insertion of sufficient coins or tokens.

11 Claims, 6 Drawing Figures

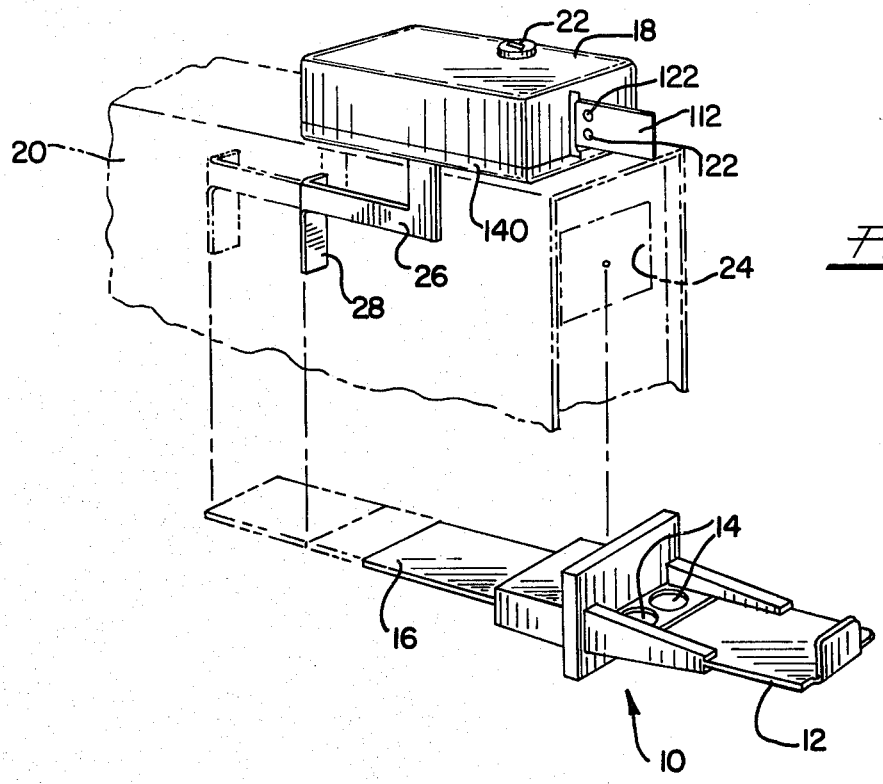
FIG. 1
FIG. 2
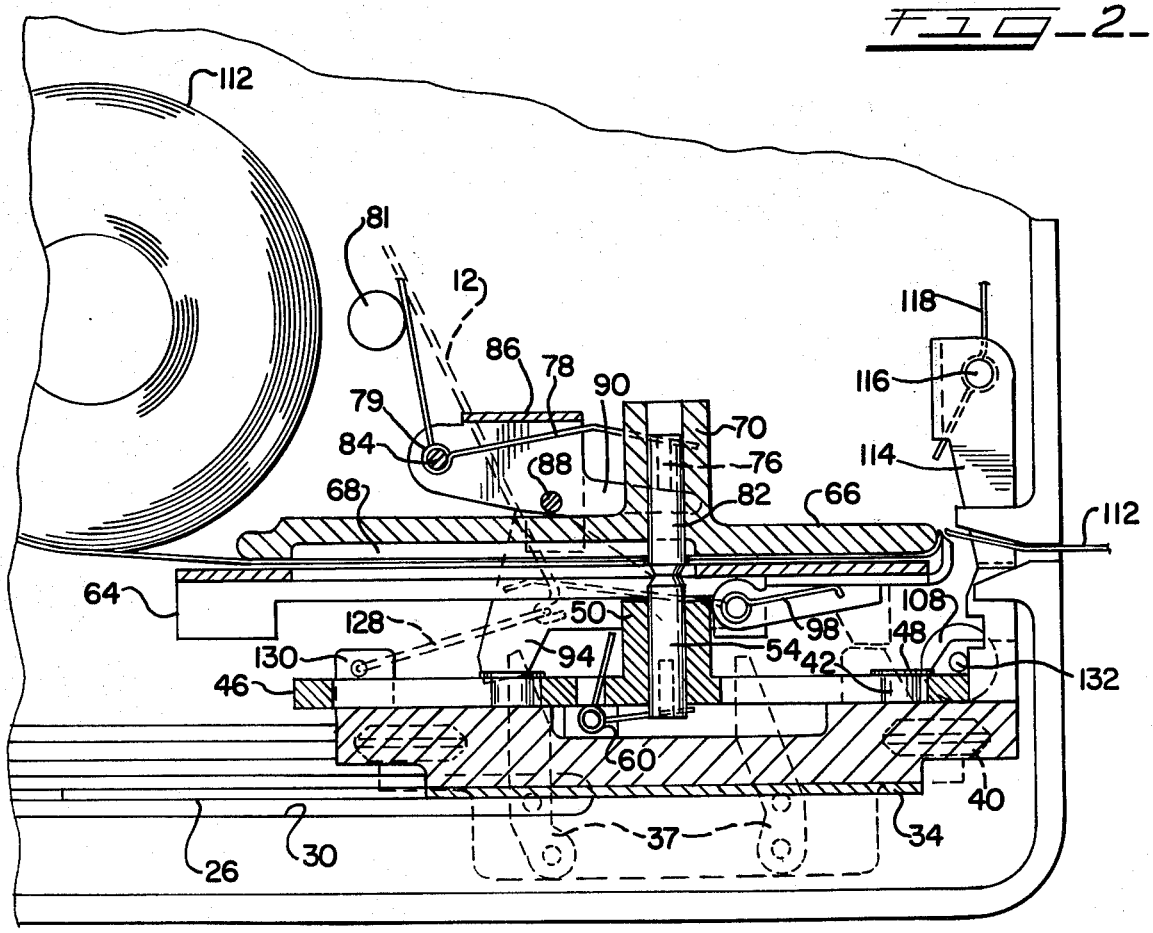

TICKET DISPENSER

BACKGROUND OF THE INVENTION

This invention relates to vending machines of the type normally utilized for the vending of goods and services. Such machines utilize coin or token accepting mechanisms and are operable only when coins or tokens (hereinafter referred to as "checks") of a predetermined value have been inserted.

There is competition for vending machine business, and ways and means for encouraging the use of particular vending machines are, therefore, desirable. For example, self-service laundry operations may provide certain amenities in addition to the provision of check operating washing and drying machines. The owners of the facilities thereby hope to attract customers who might otherwise utilize services of a competitor.

One technique employed for attracting business has been the issuing of chances or the like with the holder of the chance being eligible for a prize when a drawing is held. In a typical operation, the chances would be issued in the form of tickets given to people entering the facility housing the vending machines.

The mere issuing of tickets to persons entering a facility creates problems since some individuals will accept tickets without actually patronizing the facility. In the absence of an individual on the premises controlling the dispensing of tickets, abuses are impossible to control. The necessity for personnel to control the system, on the other hand, increases costs to the extent that the system is undesirable.

SUMMARY OF THE INVENTION

The subject matter of this invention involves the utilization of mechanisms associated with vending machines whereby tickets can be dispensed by the machines in addition to the vending of goods or services. The invention particularly involves a ticket dispensing means associated with a vending machine and operably connected to actuating means utilized for vending the goods or services. The actuating means will, in turn, be operable only upon the insertion of checks of a predetermined value. Since the ticket dispensing mechanisms will not operate except in conjunction with the actuating mechanisms of the vending machine, the ticket dispensing will occur only when a machine is actually used. Accordingly, only true patrons of the vending machine facility will be eligible for the prizes or other items of value upon the holding of a drawing or the like.

DESCRIPTION OF THE DRAWINGS

FIG. 1 is a perspective view of a vending machine coin chute in association with a ticket dispensing mechanism of the type contemplated by this invention;

FIG. 2 is a fragmentary, horizontal, cross-sectional view illustrating the structure of the ticket dispensing mechanism after movement of a ticket to a delivery position;

DESCRIPTION OF THE PREFERRED EMBODIMENT

Figure 3:
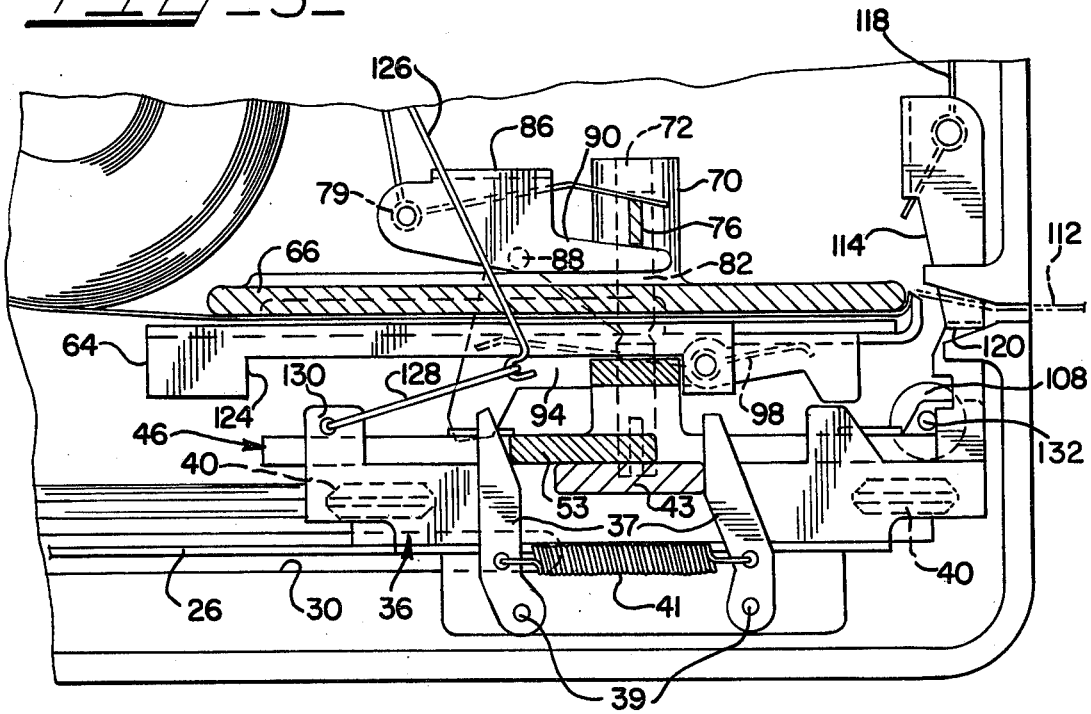
FIG. 3 is a fragmentary, horizontal, cross-sectional view illustrating the ticket dispensing mechanisms at a different level.

FIG. 1 of the drawings schematically illustrates the manner in which the apparatus of this invention can be associated with a vending machine. As illustrated, the apparatus finds particular application in association with vending machines of the type including a coin accepter 10, this accepter having a coin chute drive member 12 defining check receiving openings 14. In accordance with the standard operation of such devices, an actuating member 16 is movable inwardly only when appropriate checks are inserted in the openings 14.

It will be understood that the invention contemplates the utilization of any standard coin accepting construction. The only requirement is that an actuating member such as shown at 16 will be movable in response to the insertion of checks of a predetermined value. This movement may take place directly and automatically due to operation of the machine as with the manually movable coin chute structure shown in the drawings. On the other hand, it is contemplated that a separate actuator could be made operable by the user of the machine upon insertion of the proper checks.

The ticket dispensing apparatus of this invention is located in a housing 18 which may be situated on the coin box 20 or at some other convenient location on a vending machine. A keyhole 22 is provided for permitting access to the housing 18 for repair purposes and for replenishing the supply of tickets. As indicated, the coin accepting construction 10 is conventionally positioned in an opening 24 so that this construction can be positioned immediately adjacent the ticket dispensing housing.

A downwardly depending member 26 including arm 28 is adapted to be engaged by the actuator 16. This permits movement of the member 26 between the solid and dotted line positions shown in FIG. 1.

The member 26, as best shown in FIGS. 2 through 5, extends upwardly through a slot 30 defined by the bottom wall 32 of the housing 18. This member includes a plate section 34 which is attached to the shuttle 36 whereby movement of the member 26 results in movement of the shuttle.

The shuttle defines on one side a flange 35 which carries a pair of fingers 37 pivotally connected at 39. A spring 41 is connected at its opposite ends to the fingers whereby the fingers are urged toward each other and into engagement with stop 43.

The bottom wall of the housing defines a groove 38 for receiving wheels 40 carried by the shuttle 36. Corresponding wheels are received by a corresponding groove defined by the upper wall of the housing (not shown) so that the movement of the shuttle is confined to the path defined by the grooves.

A pair of pins 42 extend outwardly from the face of the shuttle opposite the plate 34. These pins are received by slots 44 which are defined by the carriage 46. Each pin defines an enlarged head 48 which extends beyond the width of the slots 44 whereby the carriage is movable relative to the shuttle but is held in association therewith.

Figure 6:
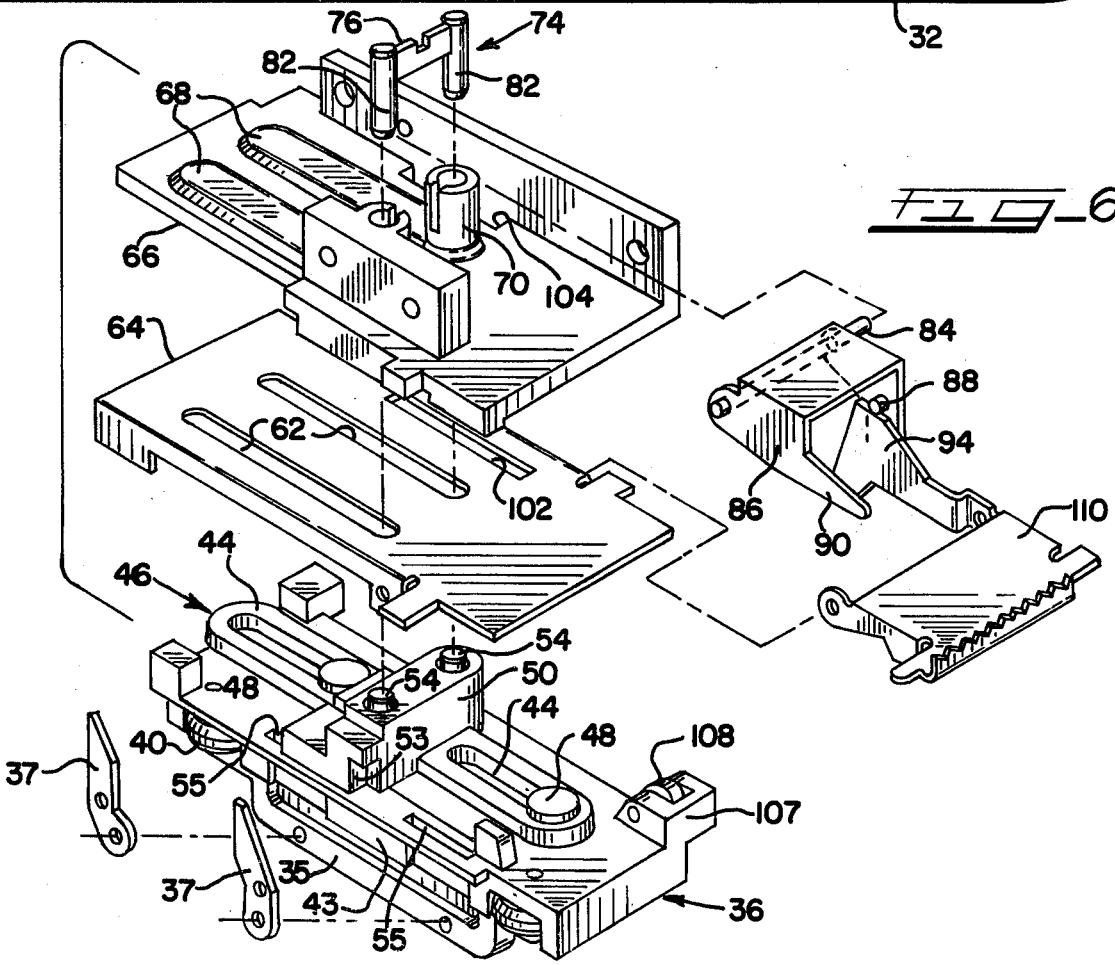

The fingers 37 carried by the shuttle extend into engagement with a stop 53 which corresponds with the stop 43 carried by the shuttle. As shown in FIG. 6, slots 55 are defined by the shuttle for receiving the fingers with the stop 43 being defined between the slots. The stop 53 is provided by an outwardly extending section of the carriage 46.

The carriage is provided with an outwardly extending molded section 50 defining a pair of bores 52. These bores each receive a pawl 54, the pawls being connected by a bridge 56. The bridge defines a notch 58 which receives one arm of a spring 60. The other arm of the spring engages the carriage whereby the spring operates to normally urge the pawl assembly outwardly relative to the bores 52.

The pawls 54 extend into slots 62 defined by ticket guide 64. This ticket guide, as well as the oppositely disposed ticket guide 66 are fixed relative to the housing 18. The ticket guide 66 defines grooves 68 for receiving the ends of pawls 54, these grooves corresponding in length with the length of slots 62.

The ticket guide 66 is provided with an outwardly extending molded section 70, this section defining a pair of bores 72. These bores receive a second pawl assembly 74 with the bridging section 76 of this assembly being engaged by spring arm 78 of spring 79. The other arm 80 of this spring engages post 81 formed in the housing 18 whereby the spring will normally urge the pawls 82 outwardly of the bores 72.

The spring 79 extends around a shaft 84, and this shaft also supports a pawl drive element 86. This drive element carries a stud 88 and an outwardly extending arm 90. The arm 90 extends beneath the bridge 76 of the pawl assembly 74 whereby pivoting movement of the arm is adapted to drive the assembly 74 in opposition to the spring arm 78.

The stud 88 is held in contact with a pivoting arm 94, this arm being supported on shaft 96 which is connected to the guide 64. A spring arm 98 bears against surface 100 of the cam 94 to normally urge the arm in a counterclockwise direction. As best shown in FIG. 6, the ticket guides 64 and 66 define corresponding slots 102 and 104 for receiving the portion of the arm 94 which extends into engagement with stud 88.

The shuttle 36 defines an ear 107 supporting a wheel 108 which rides along the adjacent edge of arm 94. As the shuttle is driven back and forth, the wheel 108 operates to pivot the arm 94 back and forth, this action in turn pivoting the element 86.

The arm 94 defines at its opposite end a cutter blade 110. This blade has a width substantially corresponding to the width of the strip of the tickets 112 being dispensed by the apparatus. The end of the blade is curved and extends just beyond the ends of the guides 64 and 66 for engagement with the strip to provide for severing of individual tickets.

Figure 5:
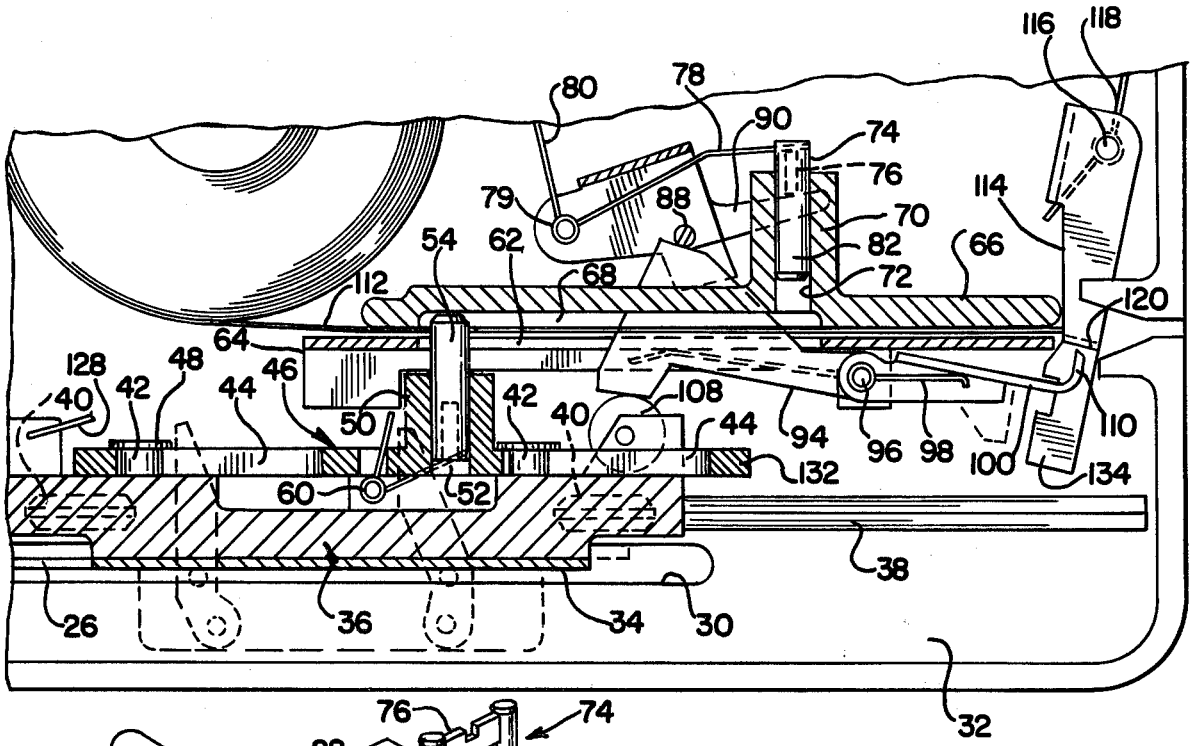
FIG. 5 is a fragmentary, horizontal, cross-sectional view illustrating the ticket dispensing mechanism with the ticket feeding means in a fully retracted position; and, FIG. 6 is an exploded view illustrating the ticket carriage and guide means utilized in the construction.

A latch 114 is pivotally supported at 116, and a spring 118 normally urges this latch toward the end of guides 64 and 66. This latch defines a shoulder 120 whereby one end of the blade 110 is adapted to engage the latch. As shown in FIG. 5, this engagement serves to hold the blade out of the path of the ticket strip. The latch 114 is positioned at the side of the guides 64 and 66 so that there is no interference with the ticket strip.

The operation of the construction described can be best understood when it is considered that the construction shown in FIG. 2 is illustrated with the blade 110 in severing engagement with the ticket strip. In this condition of the apparatus, a ticket 112 as shown in FIG. 1, is, therefore, accessible to the user of the vending machine. The ticket strip is perforated with the blade 110 engaging along a perforated line so that when the user pulls on a ticket, the sharp, serrated edge of the blade aids in separating the ticket. Other tickets in the strip are not accessible because the strip is locked against movement. The ear 109 defined by the shuttle facilitates the severing action since this ear engages protrusion 111 defined by the blade which prevents depression of the blade while a user is tearing off a ticket.

When the next user of the vending machine inserts checks of an appropriate value, the member 26 will be driven rearwardly carrying the shuttle 36 with it. This action initially involves movement of the shuttle only and then pick-up of the carriage 46. The stops 43 and 53, being of the same width, operate in conjunction with the fingers 37 to hold the shuttle and carriage in alignment until the assembly reaches the position of FIG. 4.

As best shown in FIG. 1, each ticket 112 defines a pair of openings 122. These openings are dimensioned to receive the pawls 54 supported by the carriage 46, these pawls being urged upwardly by the spring 60 when the carriage reaches the position of FIG. 4.

Figure 4:
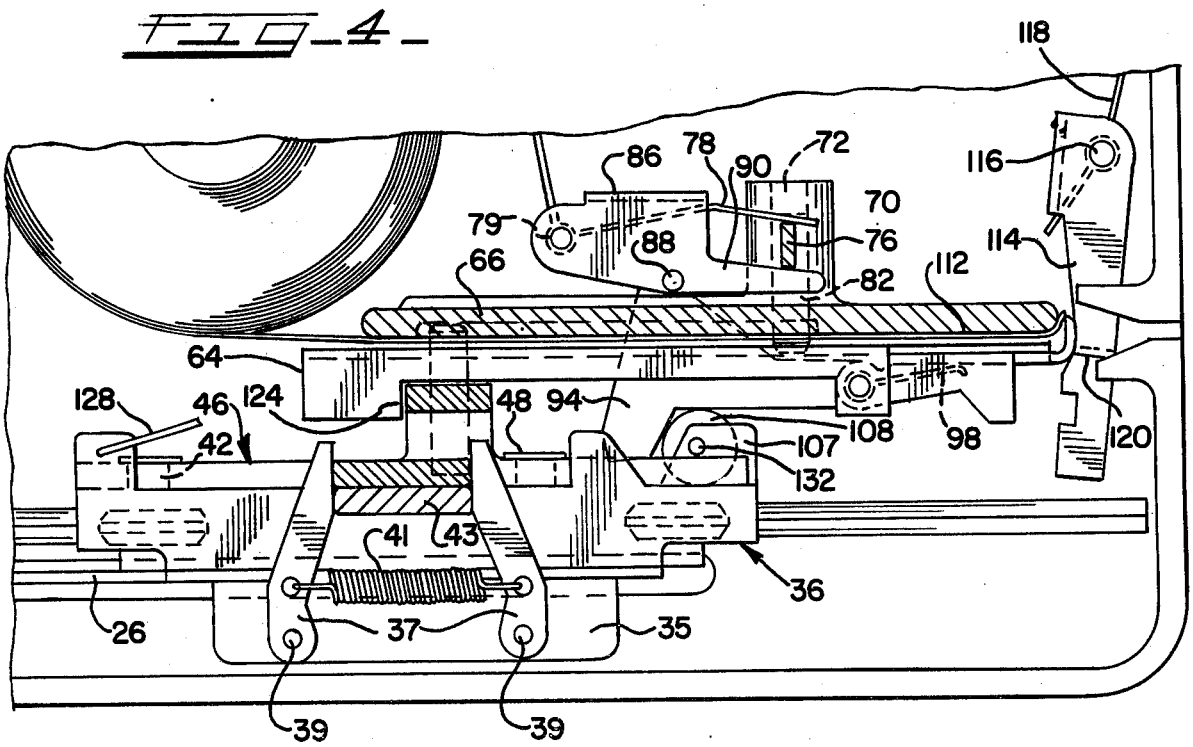
FIG. 4 is a fragmentary, horizontal, cross-sectional view illustrating the ticket dispensing mechanism with the ticket feeding means in a partially retracted position.

The shuttle 36 continues movement beyond the position of FIG. 4; however, the carriage 46 is prevented from such additional movement because of the shoulder 124 defined by the ticket guide 64. Overtravel of the shuttle relative to the carriage results in movement of the stop member 43 of the shuttle beyond the stop member 53 of the carriage in opposition to the spring 41 connecting the fingers 37.

The movement of the shuttle from the position of FIG. 4 to the position of FIG. 5 pivots the arm 94 through the action of roller 108. This results in raising of the pawls 82 in response to the action of arm 90. In addition, pivoting of the arm 94 lowers the blade 110 whereby the spring 118 drives the blade latch 114 into latching position. Accordingly, when the shuttle movement is reversed, the pawls 82 will remain in the retracted position, and the blade 110 will also remain in the retracted position.

A spring 126 is connected to the main housing at one end and to a link 128 at its other end, this link being attached to an ear 130 formed on the shuttle 36. This spring insures return of the assembly to a ticket dispensing position. This return movement results in pick-up of the carriage by the shuttle, the alignment of the shuttle and carriage again being controlled by the stop members 43 and 53 and the associated fingers 37.

When the construction has been driven back to the position of FIG. 2, the pawls 82 are brought into alignment with the pawls 54 whereby the pawls 82 are adapted to enter the openings 122 in the tickets 112. The spring 79 which urges the pawls 82 into these openings is a stronger spring than the spring 60 whereby the pawls 82 will drive the pawls 54 out of the openings. The pawls 82 thus serve to lock the ticket strip in position during the next retracting movement of the assembly.

As already indicated, these pawls 82 are moved out of locking position when the roller 108 drives the arm 94 upwardly. It is noted that this occurs after the pawls 54 enter a succeeding pair of openings so that the strip is locked in position by the pawls 54 before being unlocked by the pawls 82. The overtravel of the shuttle after locking action by the pawls 54 achieves this unlocking. The shuttle is then prepared to index the ticket strip toward the delivery position of the housing.

The return movement of the assembly to the position of FIG. 2 results in unlatching of the blade 110 when an extension of pin 132 which supports wheel 108 on the shuttle engages the end 134 of the latch 114. This releases the blade 110 so that the associated spring will positively drive the blade against the ticket strip to achieve the severing operation. It will be appreciated that the blade as well as the pawls 82 will not interfere with the indexing movement of the ticket strip since these elements are held out of the path of movement until the ticket strip indexes to its full extent.

The unlatching occurs upon overtravel of the shuttle relative to the carriage since stop 136 limited the carriage movement. This insures alignment of the pawls 54 with the pawls 82.

As particularly indicated in FIG. 1, the housing 18 consists of a base 140 having any suitable fasteners for attachment of the housing to a vending machine. The member 26 can be of any suitable shape whereby the mechanisms within the housing 18 will be operable in conjunction with the vending machine. It will, thus, be apparent that the apparatus of this invention can be quite conveniently adapted to a variety of different machines by simply accommodating the shape of the member 26 to such machines. The mechanisms within the housing 18 do not need to be changed in order to be operable by a particular machine.

It will be understood that various changes and modifications may be made in the above described construction which provide the characteristics of this invention without departing from the spirit thereof, particularly as defined in the following claims.

That which is claimed is:

1. In a machine of the type providing for the vending of goods or services upon the insertion of a check into the machine, said machine including vending actuating means operable only upon the insertion of checks of a predetermined value, the improvement comprising ticket dispensing means associated with the machine whereby a ticket is dispensed by the machine in addition to said vending, a supply of said tickets, a ticket delivery position, said dispensing means including means for feeding said tickets one at a time to said delivery position, said feeding means being operated by said actuating means whereby said feeding means will feed a ticket to the delivery position only when checks of said predetermined value have been inserted in said machine, said feeding means comprising a reciprocating indexing means, at least one opening defined by each of said tickets, said indexing means including first pawl means adapted to be received in said opening for engaging each ticket, said first pawl means being received in said opening prior to a forward stroke of said indexing means for feeding movement of a ticket to said delivery position, additional pawl means positioned for alignment with said first mentioned pawl means at the forward position of said indexing means, and means for driving said additional pawl means against said first mentioned pawl means for removing said first mentioned pawl means from said opening whereby said first mentioned pawl means are free for movement relative to said tickets during the return movement of said indexing means.

2. A construction in accordance with claim 1 including a carriage supporting said first pawl means, and a shuttle for supporting said carriage.

3. A construction in accordance with claim 2 wherein said carriage is movable relative to said shuttle, and including resilient means for forcing said carriage into a predetermined position relative to said shuttle when said first pawl means are moved to said forward position of said indexing means whereby said first pawl means are aligned with said additional pawl means in said forward position.

4. A machine in accordance with claim 3 wherein said machine actuating means are in driving engagement with said shuttle.

5. An apparatus in accordance with claim 1 including a housing for said dispensing means, and means for mounting said housing on said machine adjacent the machine actuating means.

6. A machine in accordance with claim 5 wherein said housing comprises a base for attachment to said machine, said tickets being movable in a plane perpendicular to said base.

7. A machine in accordance with claim 6 including a cutting blade for severing individual tickets when the tickets arrive at the delivery position, said feeding means comprising an indexing means having a forward stroke and a return stroke, and means for latching said cutting blade out of the path of movement of said tickets during the forward stroke of the indexing means.

8. A machine in accordance with claim 7 including means defined by said indexing means for engaging said cutting blade at the end of the forward stroke of the indexing means for de-latching of the cutting blade.

9. A machine in accordance with claim 8 wherein the means for de-latching the cutting blade operate after said tickets arrive at the delivery position.

10. A machine in accordance with claim 1 wherein said additional pawl means lock said tickets in place during return movement of said indexing means, and means for driving said additional pawl means out of said opening after said first mentioned pawl means are received in the opening of the next ticket.

11. In a machine of the type providing for the vending of goods or services upon the insertion of a check into the machine, said machine including vending actuating means operable only upon the insertion of checks of a predetermined value, the improvement comprising ticket dispensing means associated with the machine whereby a ticket is dispensed by the machine in addition to said vending, a supply of said tickets, a ticket delivery position, said dispensing means including means for feeding said tickets one at a time to said delivery position, means operatively connecting said feeding means to said actuating means whereby said feeding means feed a ticket to the delivery position only when checks of said predetermined value have been inserted in said machine, said feeding means comprising a reciprocating indexing means, openings defined by said tickets, said indexing means including first pawl means adapted to be received in an opening for engaging each ticket, said first pawl means being received in an opening prior to a forward stroke of said indexing means for feeding movement of a ticket to said delivery position, additional pawl means adapted to be received in an opening at the forward position of said indexing means, said additional pawl means locking said tickets in place during return movement of said indexing means, means for removing said first mentioned pawl means from an opening whereby said first mentioned pawl means are free for movement relative to said tickets during the return movement of said indexing means to thereby align said first pawl means with an opening in the next ticket, and means for driving said additional pawl means out of a ticket opening after said first mentioned pawl means is received in an opening of the next ticket.

* * * * *